US012471730B1

(12) United States Patent
Baldocchi

(10) Patent No.: US 12,471,730 B1
(45) Date of Patent: Nov. 18, 2025

(54) CURTAIN ROD ASSEMBLY

(71) Applicant: Robert Steven Baldocchi, San Marino, CA (US)

(72) Inventor: Robert Steven Baldocchi, San Marino, CA (US)

( * ) Notice: Subject to any disclaimer, the term of this patent is extended or adjusted under 35 U.S.C. 154(b) by 0 days.

(21) Appl. No.: 18/383,735

(22) Filed: Oct. 25, 2023

(51) Int. Cl.
*A47H 1/144* (2006.01)
*A47H 1/06* (2006.01)
*A47H 1/04* (2006.01)

(52) U.S. Cl.
CPC ..... *A47H 1/144* (2013.01); *A47H 1/06* (2013.01); *A47H 2001/042* (2013.01)

(58) Field of Classification Search
CPC ..... A47H 1/144; A47H 1/06; A47H 1/102; A47H 1/104; A47H 2001/042
See application file for complete search history.

(56) References Cited

U.S. PATENT DOCUMENTS 2,528,848 A * 11/1950 Weinzimmer ..... A47H 1/06 160/19
5,259,520 A * 11/1993 Roggio ..... A47H 15/04 16/95 D
6,672,359 B2 * 1/2004 Morris ..... A47H 2/00 160/19
7,370,839 B2 * 5/2008 Putman ..... A47H 1/102 248/261
7,699,278 B2 * 4/2010 Goldstein ..... A47H 1/142 248/220.21
8,833,427 B2 * 9/2014 Kazuma ..... A47H 15/04 160/202
9,445,683 B1 * 9/2016 Rochin ..... A47H 1/04
9,480,357 B2 * 11/2016 Price ..... A47H 15/02
D980,048 S * 3/2023 Wexler ..... D8/373
2005/0022950 A1 * 2/2005 Putman ..... A47H 1/102 160/330
2011/0225774 A1 * 9/2011 Seddon ..... A47H 1/02 16/94 D
2012/0002409 A1 * 1/2012 Donauer ..... A47H 1/144 362/218
2012/0018106 A1 * 1/2012 Robledo ..... A47H 1/04 160/330
2013/0092646 A1 * 4/2013 Wang ..... A47H 1/142 211/123
2020/0146494 A1 * 5/2020 Yang ..... A47H 1/022
2023/0263328 A1 * 8/2023 Ko ..... F16B 5/0685 248/221.11

FOREIGN PATENT DOCUMENTS

DE 537028 C * 10/1931
DE 1040760 B * 10/1958
DE 20311113 U1 * 10/2003 ..... A47H 1/14
DE 202012004360 U1 * 10/2012 ..... A47H 1/144
GB 802124 A * 10/1958 ..... A47H 1/144

* cited by examiner

*Primary Examiner* — Jason W San
*Assistant Examiner* — Matthew J Sullivan
(74) *Attorney, Agent, or Firm* — Plager Schack LLP; Mark H. Plager; Naomi Mann

(57) ABSTRACT

Disclosed is a curtain rod hanging assembly which may comprise a curtain rod, and a rod attachment assembly configured to attach the curtain rod to a wall, wherein the curtain rod may comprise an elongated tube including a bottom slot opening and an inner support track for supporting one or more curtain hooks, and the rod attachment assembly is provided on an outer side of the curtain rod to leave the inner support track uninterrupted.

12 Claims, 4 Drawing Sheets

CURTAIN ROD ASSEMBLY

BACKGROUND

The present disclosure relates generally to curtain rod systems and curtain hanging devices.

Curtains may be hung on the inside of a window or glass door entrance way and are generally useful for blocking light, providing privacy, and/or creating a separation between spaces. Curtains may also provide home/widow decor which may augment/enhance the overall appearance of an interior space. Typically, curtains may be hung using a rod placed above the window or entrance way. As such, an improved system for hanging curtains which may provide enhanced user experience and/or improve the curtain's overall appearance is desirable.

SUMMARY

According to various embodiments, disclosed is a curtain rod hanging assembly which may comprise a curtain rod, and a rod attachment assembly configured to attach the curtain rod to a wall. In certain embodiments, the curtain rod may comprise an elongated tube including a bottom slot opening and an inner support track, wherein the inner support track is disposed within an internal side of the curtain rod and is configured to slidably support one or more curtain hooks. The rod attachment assembly may comprise at least one rod receiving bracket and at least one wall bracket, the rod receiving bracket comprising a rod attachment component configured to couple to the curtain rod at an external side of the curtain rod to leave the inner support track unobstructed.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
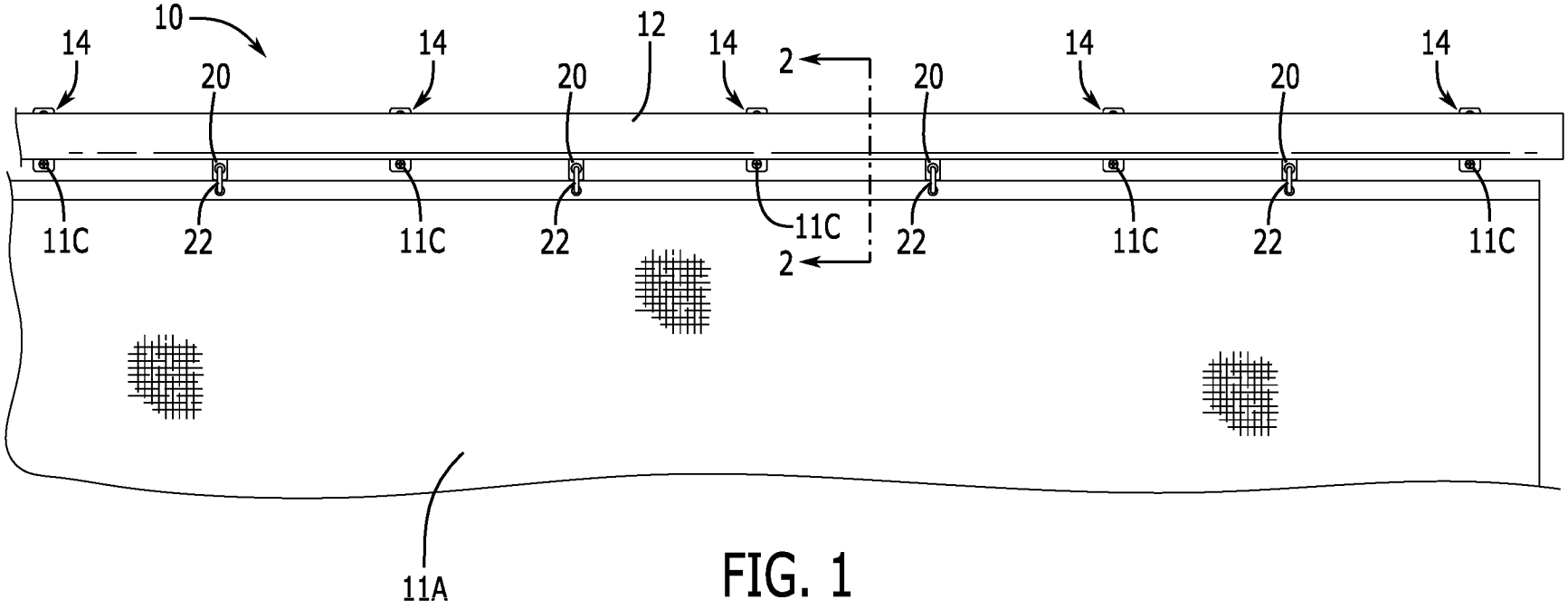
FIG. 1 is a front elevation view of a curtain rod assembly shown in use, according to certain embodiments.

According to various embodiments as depicted in FIGS. 1-8 disclosed is a curtain hanging system which provides a curtain rod hanging assembly 10 (curtain rod assembly 10) comprising a curtain rod 12 with an inner support track 12A for hanging one or more curtain(s) 11A.

In certain embodiments, curtain rod 12 may comprise an elongated tube with bottom opening or slot 24 extending along the length of curtain rod 12 and providing access to inner support track 12A. Inner support track 12A may provide an internal platform which extends along the length of the rod and is configured to slidably support one or more curtain hook(s) 20.

In certain embodiments, curtain rod assembly 10 may comprise a rod attachment assembly 14 for attaching curtain rod 12 to a wall 11B or other surface. Rod attachment assembly 14 may comprise a plurality of rod receiving brackets 18 configured to couple to curtain rod 12 at an external side of the curtain rod. In certain embodiments, the rod receiving brackets 18 may be attached at spaced intervals along the length of the curtain rod. This provides an arrangement which isolates the inner support track 12A on which the curtain hooks are supported, from the components used to hang the rod itself (i.e., rod attachment assembly 14). As such, inner support track 12A may provide a curtain hook support platform which is uninterrupted by the rod hanging components and allows curtain hook(s) 20 to freely slide along the entire length of curtain rod 12 without being blocked by components of the rod attachment assembly. Additionally, as inner support track 12A is internal to curtain rod 12, at least an upper portion of each curtain hook 20 may be concealed within curtain rod 12 for improved aesthetics.

In certain embodiments as depicted in the figures, curtain rod 12 may be formed from an elongated sheet which is curved to create a substantial enclosure 12C, wherein opposing bottom end sections 12B of the sheet fold or curve upwards and outwards into the enclosure in a spiraling configuration, forming slot opening 24 at the bottom of enclosure 12C and further forming a raised internal platform within enclosure 12C defining inner support track 12A. In some embodiments as depicted, enclosure 12C may be rounded. It shall be appreciated however, that different geometric/structural configurations may be used in alternate embodiments. For example, enclosure 12C may be square, rectangular, hexagonal, oval, etc. in alternate embodiments.

In certain embodiments, curtain hooks 12 of curtain rod assembly 10 may each comprise a generally horizontal upper part 20A, and a generally vertical lower part 20B extending downwards from an intermediate and/or central location of horizontal upper part 20A. In one embodiment, curtain hooks 12 may each have a "T" shape as depicted in the figures, but are not limited to this option. In further embodiments, an opening 20C may be provided within vertical lower part 20B and is configured to engage a curtain joint member 22, such as a ring or hook, from which curtain 11A may hang.

Figure 2:
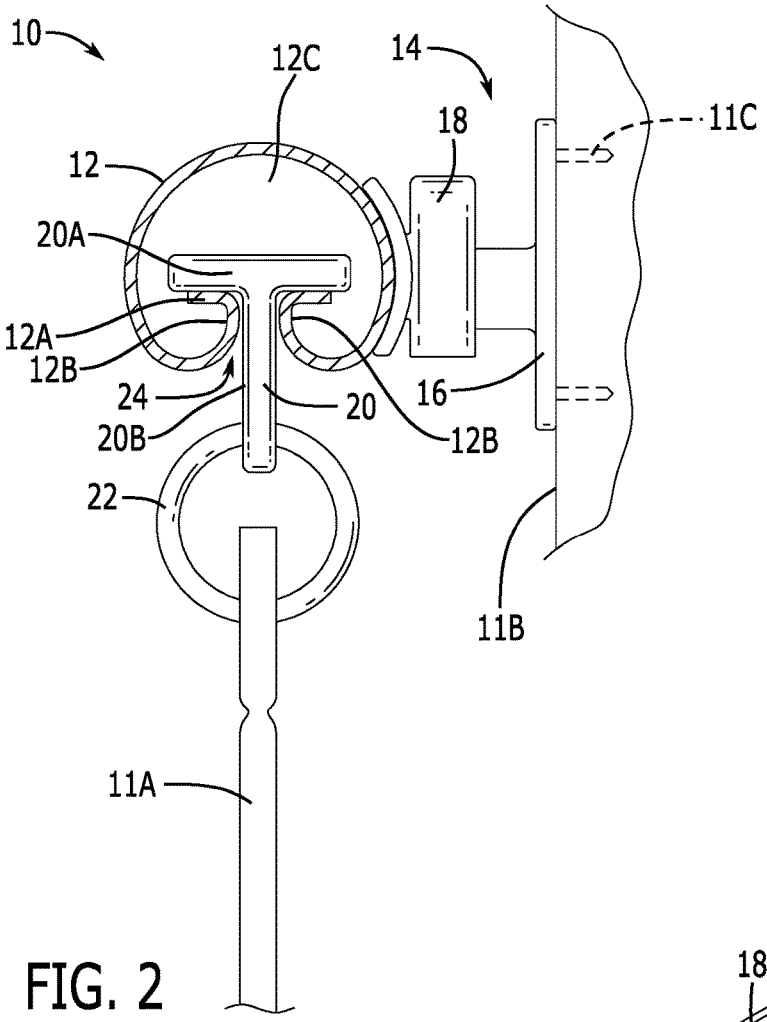
FIG. 2 is a cross-sectional view taken on line 2-2 of FIG. 1.
Figure 3:
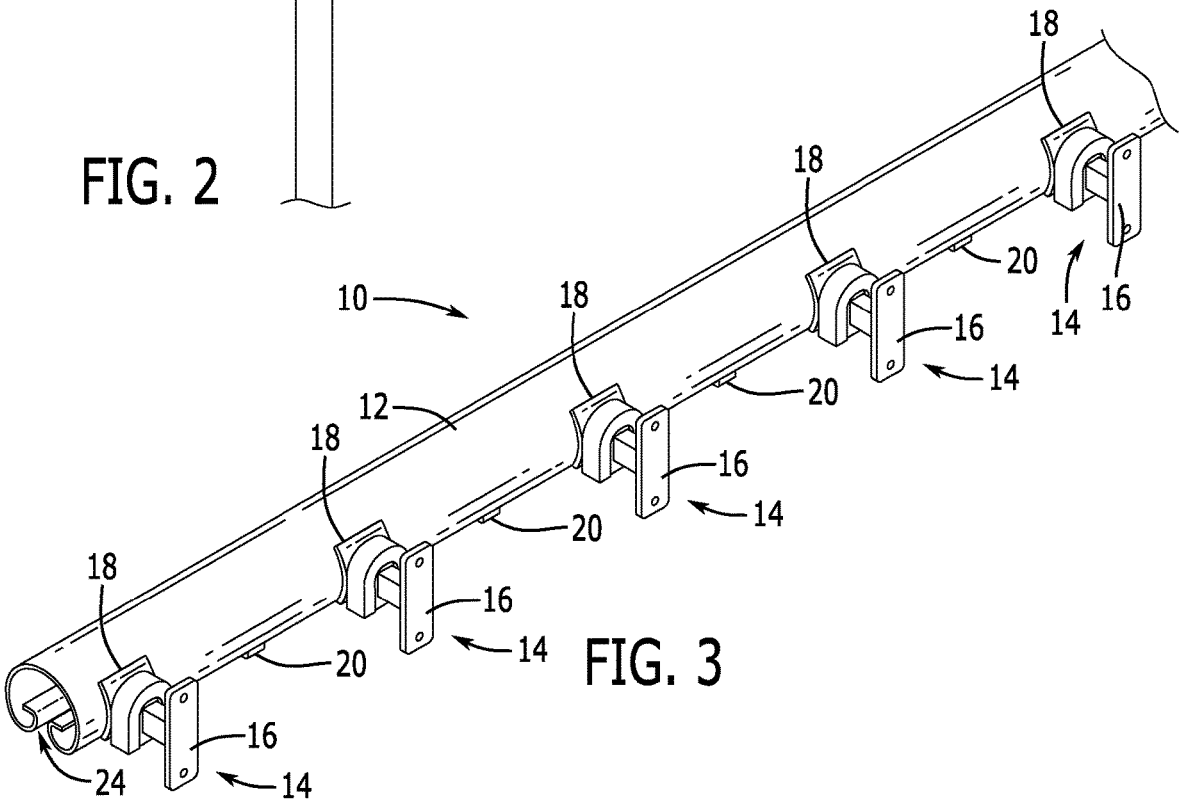
FIG. 3 is a rear perspective view of the curtain rod assembly.
Figure 4:
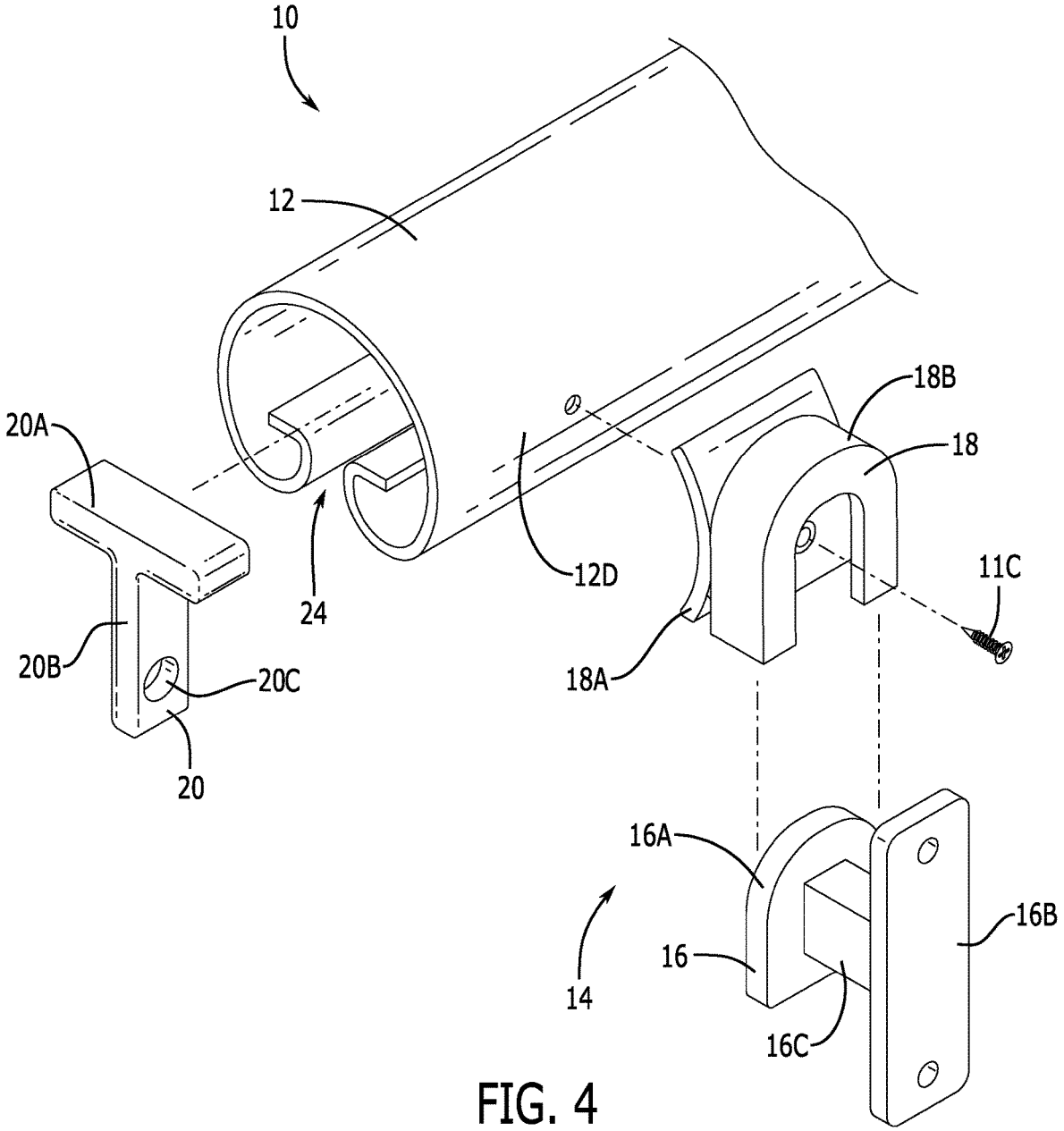
FIG. 4 is a detailed exploded perspective view of the curtain rod assembly.
Figure 5:
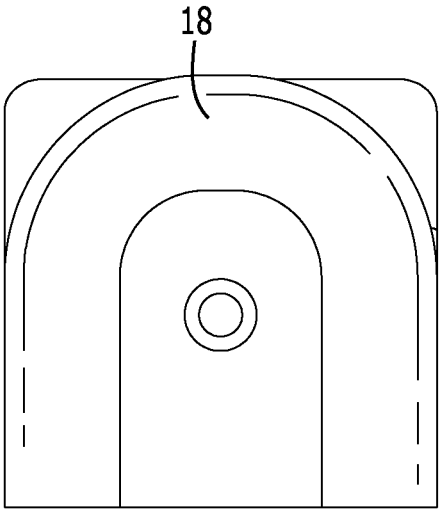
FIG. 5 is a front elevation view of a rod receiving bracket of the curtain rod assembly.
Figure 6:
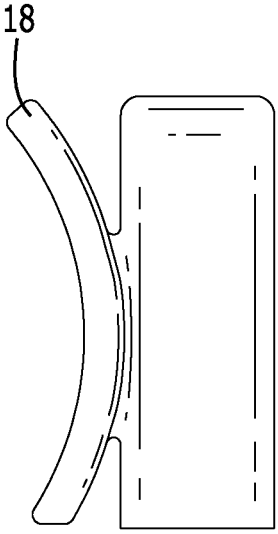
FIG. 6 is a side elevation view of the rod receiving bracket.
Figure 7:
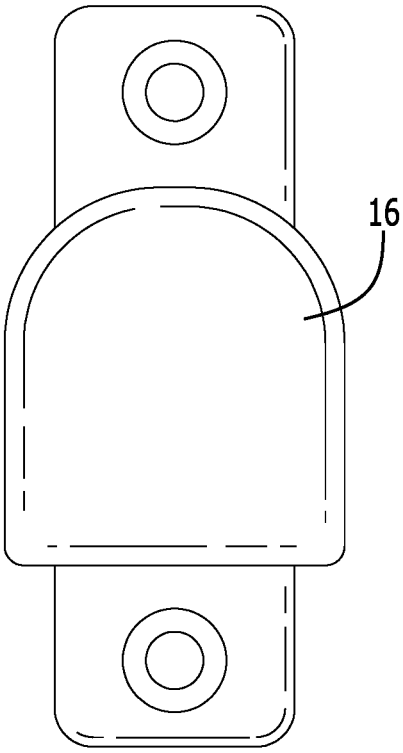
FIG. 7 is a front elevation view of a wall bracket for the curtain rod assembly.
Figure 8:
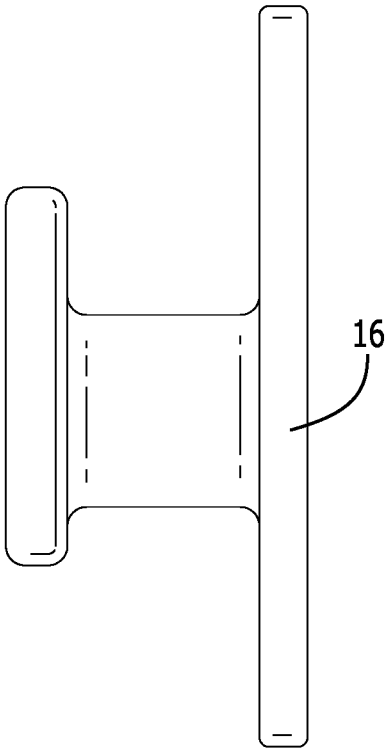
FIG. 8 is a side elevation view of the wall bracket.

In embodiments as best depicted in FIGS. 2-4, inner support track 12A is configured to engage curtain hooks 20. In some embodiments, inner support track 12A may comprise a flat raised surface within enclosure 12C which is configured to support horizontal upper part 20A of hook 20 while enabling vertical lower part 20B of the hook to extend downwards through slot opening 24. Curtain hooks 20 may be inserted into rod 12 by orienting horizontal upper part 20A of each hook to align with opening 24 and/or parallel to the long axis of rod 12, inserting or pushing the hook into opening 24 so horizontal upper part 20A passes above inner support track 12A, then twisting hook 20 such that horizontal upper part 20A aligns perpendicular to opening 24 and/or the long axis of rod 12 and sits atop inner support track 12A.

In certain embodiments, rod receiving brackets 18 of rod attachment assembly 14 may be coupled to the outer surface of curtain rod 12 on a rear or wall-facing side 12D of the rod. Rod attachment assembly 14 may further comprise a wall bracket 16 configured to couple between wall 11B and brackets 18 for attachment of curtain assembly 10 to the wall. In some embodiments, rod receiving brackets 18 may each comprise a rod attachment component 18A configured to directly attach to the rod, and a wall bracket connector 18B configured to be supported on wall bracket 16. Wall brackets 16 may each comprise a rod bracket engagement member 16A configured to support wall bracket connector 18B, and a wall attachment member 16B configured to attach to wall 11B via fasteners 11C. In further embodiments, a spacing member 16C may be provided between rod bracket engagement member 16A and wall bracket connector 18B.

In certain embodiments, rod attachment component 18A may be curved to conform to the curvature of rod 12 and may be attached to the outer surface of the rod via fasteners 11C such as screws engaged through corresponding holes within attachment component 18A and rod 12. Wall bracket connector 18B may be disposed on a wall-facing side of rod attachment component 18A opposite curtain rod 12. In certain embodiments, wall bracket connector 18B is configured to be supported atop rod bracket engagement member 16A. In some embodiments, wall bracket connector 18B may further be configured to at least partially surround rod bracket engagement member 16A, as shown. However, in other embodiments, rod bracket engagement member 16A may be configured to at least partially surround wall bracket connector 18B as will be described.

In some embodiments, wall bracket connector 18B may comprise an arched shaped body outlining an inner slot configured to receive rod bracket engagement member 16A of wall bracket 16. Engagement member 16A may comprise an arched shaped body configured to fit within the arched shaped slot of bracket connector 18B. This configuration provides a guided engagement which allows wall bracket connector 18B to be securely supported atop rod bracket engagement member 16A to form a stabilized non-permanent connective engagement. In some embodiments, wall bracket connector 18B and rod bracket engagement member 16A may be made of magnetically attractive metals such that the connective engagement between wall bracket connector 18B and engagement member 16A is made further secure via magnetic forces. As such, curtain rod 12 may be attached to wall 11B via engagement between a plurality of rod receiving brackets 18 attached to curtain rod 12 and an equal number of wall brackets 16 attached to wall 11B, wherein the rod receiving brackets 18 are attached in a linear horizontal arrangement at spaced intervals along the wall facing side 12D of the rod, and the wall brackets are attached in a corresponding linear horizontal arrangement to wall 11B. This connective arrangement between rod receiving brackets 18 and wall brackets 16 further allows the rod to be easily removed and re-hung, as no hardware is used to attach the sets of brackets.

It shall be appreciated that attachment assembly 14 may have different configurations in alternate embodiments. For example, rod bracket engagement member 16A may comprise an inverted slot (similar to wall bracket connector 18B but inverted), and wall bracket connector 18B may comprise an inverted arched shaped body (similar to rod bracket engagement member 16A but inverted). In some other embodiments, wall bracket connector 18B and rod bracket engagement member 16A may have a different geometric shapes (e.g., square, triangular, etc.). In other alternate embodiments, wall bracket connector 18B and rod bracket engagement member 16A may be configured to snap fit and/or may use connective hardware. In some other embodiments, wall brackets 16 may be configured to directly attached to the wall.

The disclosed curtain rod assembly 10 allows curtain 11A to slide along length of curtain rod 12, end to end, without interruption from components of the attachment assembly 14, and provides a stable curtain hanging system that can span any width. This allows the user to install a single panel of curtain, if desired, rather than multiple panels for covering a large area. Additionally, the elimination of interference by the attachment components allows any number of attachment components to be used, thus avoiding sag in the curtain rod.

The disclosed system may be used for installation of window and glass doorway curtains for home and commercial interiors, but may be used for other applications, such as shower curtains, room dividers, booth curtains (e.g., for a trade show booth), etc., in alternate embodiments.

It shall be appreciated that the disclosed device and system can have multiple configurations in different embodiments. In certain embodiments, the system may incorporate other components such as decorative end pieces, decorative brackets, etc. It shall be appreciated that the device and system described herein may comprise any alternative known materials in the field and be of any size and/or dimensions. In some embodiments, the curtain rod may be made of metal or wood, and the bracket assembly components may be made of metal but are not limited to this option. It shall be appreciated that the device may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated device or element must have a specific orientation or are constructed and operated in a specific orientation, and therefore should not be construed as a limitation of the present invention.

As used herein, the articles "a" and "an" are intended to include one or more items and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A curtain rod hanging assembly comprising:

a curtain rod; and a rod attachment assembly configured to attach the curtain rod to a wall, the curtain rod comprising an elongated tube including a bottom slot opening and an inner support track, the bottom slot opening and the inner support track extending along the length of the elongated tube, wherein the inner support track is disposed within an internal side of the curtain rod and is accessible through the bottom slot opening, wherein the inner support track is configured to slidably support one or more curtain hooks, wherein the rod attachment assembly comprises at least one rod receiving bracket and at least one wall bracket, the rod receiving bracket comprising a rod attachment component configured to couple to the curtain rod at an external side of the curtain rod and on a wall facing side of the curtain rod, the rod receiving bracket further comprising a wall bracket connector configured engage with a rod bracket engagement member of the wall bracket, the wall bracket further comprising a wall attachment member opposite the rod bracket engagement member and configured to attach to a wall, wherein the wall bracket connector is configured to be supported on the rod bracket engagement member of the wall bracket, wherein the rod bracket engagement member is configured to at least partially surround the wall bracket connector, wherein the rod bracket engagement member comprises an inverted arched shaped body outlining an inner slot configured to receive the wall bracket connector, and wherein the wall bracket connector comprises an inverted arched shaped body configured to fit within the inverted arched shaped slot of the rod bracket engagement member.

2. The curtain rod hanging assembly of claim 1, the rod attachment assembly comprising a plurality of rod receiving brackets configured to attach to the curtain rod in a linear horizontal arrangement at spaced intervals along the length of the curtain rod.

3. The curtain rod hanging assembly of claim 1, the curtain rod being formed from an elongated sheet which is curved to create an enclosure defining the internal side of the curtain rod, wherein opposing bottom end sections of the sheet are curved upwards and outwards into the enclosure to form a raised internal platform within the enclosure, the raised internal platform defining the inner support track, wherein the bottom slot opening is formed between the bottom end sections of the sheet.

4. The curtain rod hanging assembly of claim 3, wherein the enclosure has a rounded shape.

5. The curtain rod hanging assembly of claim 1, wherein the inner support track comprises a flat raised surface within enclosure which is configured to support a horizontal upper part of the curtain hook, while enabling a vertical lower part of the curtain hook to extend downwards through the bottom slot opening.

6. The curtain rod hanging assembly of claim 1, wherein the wall bracket further comprises a spacing member between rod bracket engagement member and the wall bracket connector.

7. A curtain rod hanging assembly comprising:

a curtain rod; and a rod attachment assembly configured to attach the curtain rod to a wall, the curtain rod comprising an elongated tube including a bottom slot opening and an inner support track, the bottom slot opening and the inner support track extending along the length of the elongated tube, wherein the inner support track is disposed within an internal side of the curtain rod and is accessible through the bottom slot opening, wherein the inner support track is configured to slidably support one or more curtain hooks, wherein the rod attachment assembly comprises at least one rod receiving bracket and at least one wall bracket, the rod receiving bracket comprising a rod attachment component configured to couple to the curtain rod at an external side of the curtain rod and on a wall facing side of the curtain rod, the rod receiving bracket further comprising a wall bracket connector configured engage with a rod bracket engagement member of the wall bracket, the wall bracket further comprising a wall attachment member opposite the rod bracket engagement member and configured to attach to a wall, wherein the wall bracket connector is configured to be supported on the rod bracket engagement member of the wall bracket, wherein the wall bracket connector is configured to at least partially surround the rod bracket engagement member, wherein the wall bracket connector comprises an arched shaped body outlining an inner slot configured to receive the rod bracket engagement member, and wherein the rod bracket engagement member comprises an arched shaped body configured to fit within the arched shaped slot of the wall bracket connector.

8. The curtain rod hanging assembly of claim 7, the rod attachment assembly comprising a plurality of rod receiving brackets configured to attach to the curtain rod in a linear horizontal arrangement at spaced intervals along the length of the curtain rod.

9. The curtain rod hanging assembly of claim 7, the curtain rod being formed from an elongated sheet which is curved to create an enclosure defining the internal side of the curtain rod, wherein opposing bottom end sections of the sheet are curved upwards and outwards into the enclosure to form a raised internal platform within the enclosure, the raised internal platform defining the inner support track, wherein the bottom slot opening is formed between the bottom end sections of the sheet.

10. The curtain rod hanging assembly of claim 9, wherein the enclosure has a rounded shape.

11. The curtain rod hanging assembly of claim 7, wherein the inner support track comprises a flat raised surface within enclosure which is configured to support a horizontal upper part of the curtain hook, while enabling a vertical lower part of the curtain hook to extend downwards through the bottom slot opening.

12. The curtain rod hanging assembly of claim 7, wherein the wall bracket further comprises a spacing member between rod bracket engagement member and the wall bracket connector.

* * * * *